US005139098A

United States Patent [19]

Blake

[11] Patent Number: 5,139,098

[45] Date of Patent: Aug. 18, 1992

[54] COMBINED DRILL AND UNDERREAMER TOOL

[76] Inventor: John Blake, 2200 El Portal, No. 9, Bakersfield, Calif. 93309

[21] Appl. No.: 765,948

[22] Filed: Sep. 26, 1991

[51] Int. Cl.[5] ..... E21B 10/34

[52] U.S. Cl. ..... 175/269; 175/334; 175/339

[58] Field of Search ..... 175/269, 267, 263; 166/366

[56] References Cited

U.S. PATENT DOCUMENTS

| | | | |
|---|---|---|---|
| 2,941,785 | 6/1960 | Kammerer | 175/267 |
| 3,126,065 | 3/1964 | Chadderdon | 175/269 |
| 3,749,187 | 7/1973 | Leathers | 175/269 |
| 4,660,657 | 4/1987 | Furse et al. | 175/269 |
| 4,865,137 | 9/1989 | Bailey et al. | 175/269 |
| 5,036,921 | 8/1991 | Pittard et al. | 175/267 |

*Primary Examiner*—Ramon S. Britts
*Assistant Examiner*—Frank S. Tsay
*Attorney, Agent, or Firm*—Dennis B. Haase

[57] ABSTRACT

A combined drill and underreamer tool capable of selectively drilling and underreaming a well hole on command, which includes a fluid distribution system wherein drilling mud under pressure is accumulated in a central chamber and from that central chamber a portion is distributed to the drill bit while another portion is distributed to the underreamer tool when that tool is operative, and, further, employing drilling mud under pressure to activate and deactivate the underreamer tool by selectively blocking and unblocking a fluid a passage thereto.

25 Claims, 4 Drawing Sheets

T
S
37
26
56
22
49
20
54
101
45
47
28
28
30
30
107
58
51
24
40

7
S
37
56
49
20
54
47
22
45
28
28
107
58
51
7
24

S
4
37
26
45
101
20
28
107
30
4
22
24

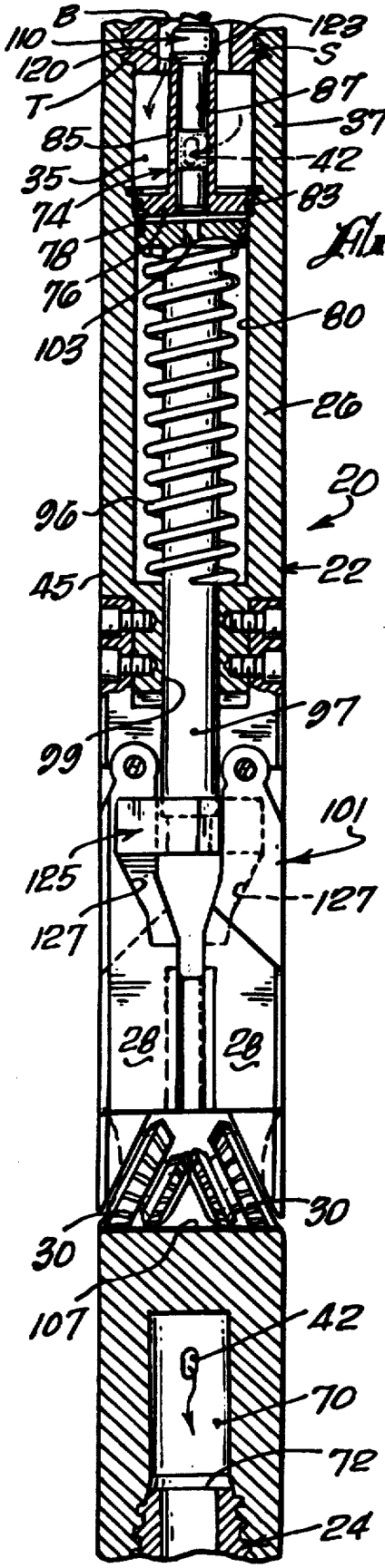
FIG. 4.
FIG. 5.
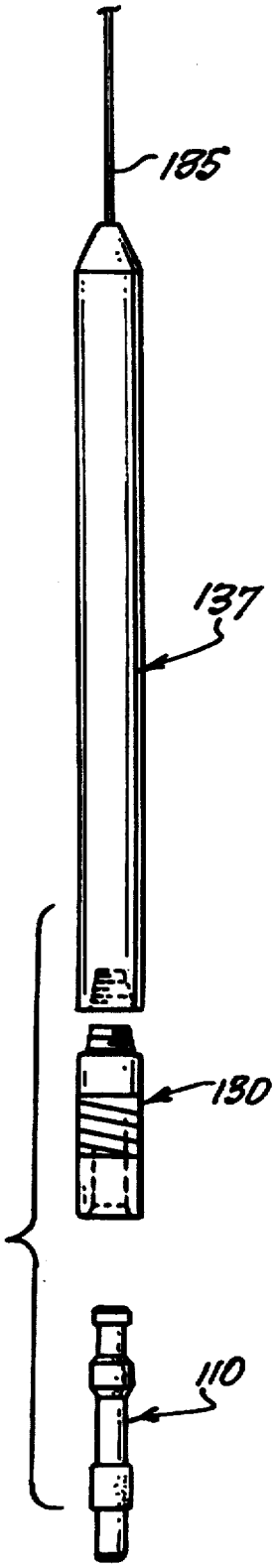

B
87
S
123
T
37
35
85
49
42
56
76
74
78
83
54
80
95
105
96
54
99
26
97
47
125
20
47
28
101
22
30
107
60
58
51
42
45
70
72
24

9
65
49
45
42
56
65
26
22
47
54
9

37
22
26
65
45
35
56
42
67
65
66
47

26
47
22
65
66
67
62
42
60
51
58

COMBINED DRILL AND UNDERREAMER TOOL

The present invention relates to tools used in the drilling and underreaming of wells, and more particularly, to a single tool capable of performing both the drilling and underreamer function.

BACKGROUND OF THE INVENTION

1. Field of the Invention

The process of drilling wells is both time consuming and exceedingly expensive. In most cases, there is no warranty that the driller will be rewarded at the bottom of the hole. One aspect of the process which adds considerably to the expense is that the entire drill string has to be pulled, from time to time, to change tools, whether to replace a dull tool, or to change tools to change functions, such as, for example, underream a production area. In shallow wells, this task is, of course, less onerous, but with each section of the drill pipe added to the string, the task requires that much more time.

While combining a drill bit and underreamer in a single tool has been attempted, such a tool, by its very nature, has posed problems in the industry in that drilling fluid, commonly referred to as "mud", is pumped down the drill string to lubricate the tool, as well as clean away debris. When tools capable of multiple function, such as the present invention, are introduced, means must be devised for the controlled distribution of drilling mud for lubrication of all of the cutters, as well as actuation and deactuation of the underreamer cutters.

2. Description of Related Art

As mentioned, drill bits and underreamer tools are generally well known in the drilling art. One example of a patented underreamer is found in Thometz et al. U.S. Pat. No. 3,712,854, which is a two-stage underreamer in which the cutter arms are fluid actuated. Thometz suggests, but does not elaborate on, the prospect of combining a drill bit with the underreamer function, and there is certainly no disclosure of an adequate drilling mud distribution system.

Boe U.S. Pat. No. 4,889,197 is illustrative of another type of underreamer employing a different cutter arrangement, and, while being hydraulically actuated, performs that function in a somewhat different manner than Thometz.

Yet another expandable tool is found in Kammerer, Jr. U.S. Pat. No. 3,050,142, and while the intent and purpose of the Kammerer tool is to combine the cylindrical body member and drill string to minimize the number of trips required up and down the hole, it nonetheless illustrates a type of tool which has gained acceptance in the art.

Finally, Furst et al. U.S. Pat. No. 4,660,657, which discusses a combination tool comprising an underreamer and a drill bit, although the objective of the patent is not the provision of such a combination tool.

SUMMARY OF THE INVENTION

The present invention relates to improvements in combination drilling and underreamer tools in which the means by which the underreamer is deployed is greatly simplified and, additionally, provides for an equally novel means of selectively distributing drilling mud, or the like, to the underreamer cutters, as well as the drill bit, which is disposed down stream of the underreamer portion of the tool.

Accordingly, it is a principal objective of the present invention to provide a combination drill bit and underreamer tool in which the underreamer function is quickly and simply activated and deactivated.

It is another objective of the present invention to provide a combination tool in which a unique drilling mud distribution system is used to control actuation of the underreamer tool in a unique manner, and when the underreamer tool is not in use, to selectively distribute the mud to the underreamer cutters, and/or the drill bit, for lubrication and cleaning purposes during drilling.

DESCRIPTION OF THE DRAWINGS

Figure 1:
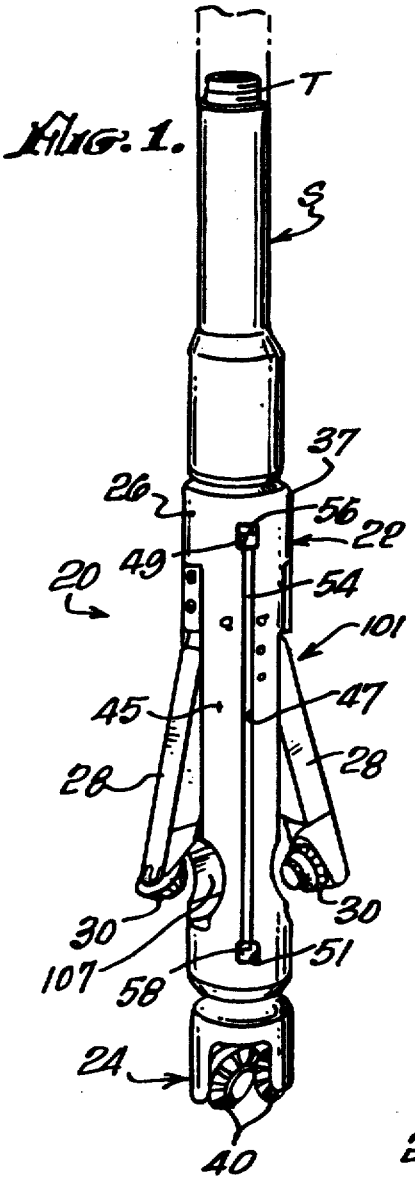
Figure 2:
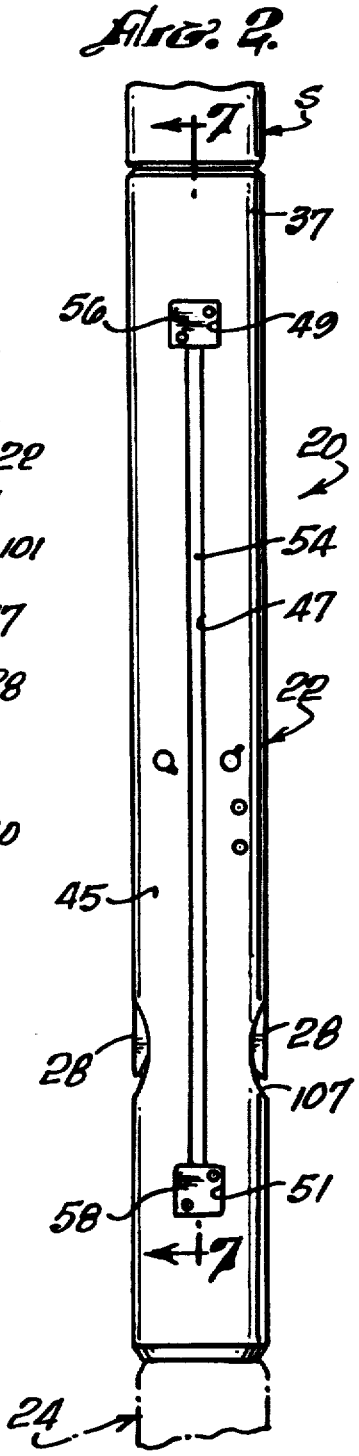
Figure 3:
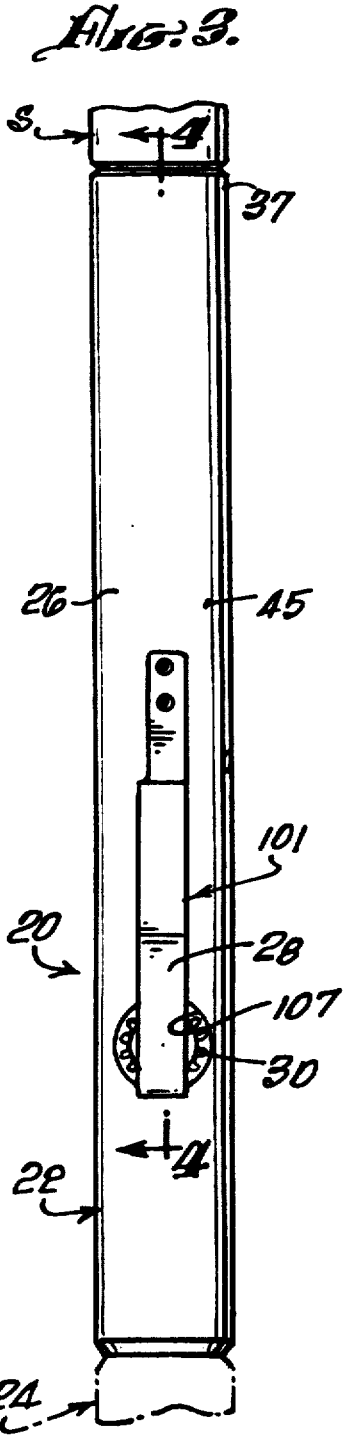
Figure 6:
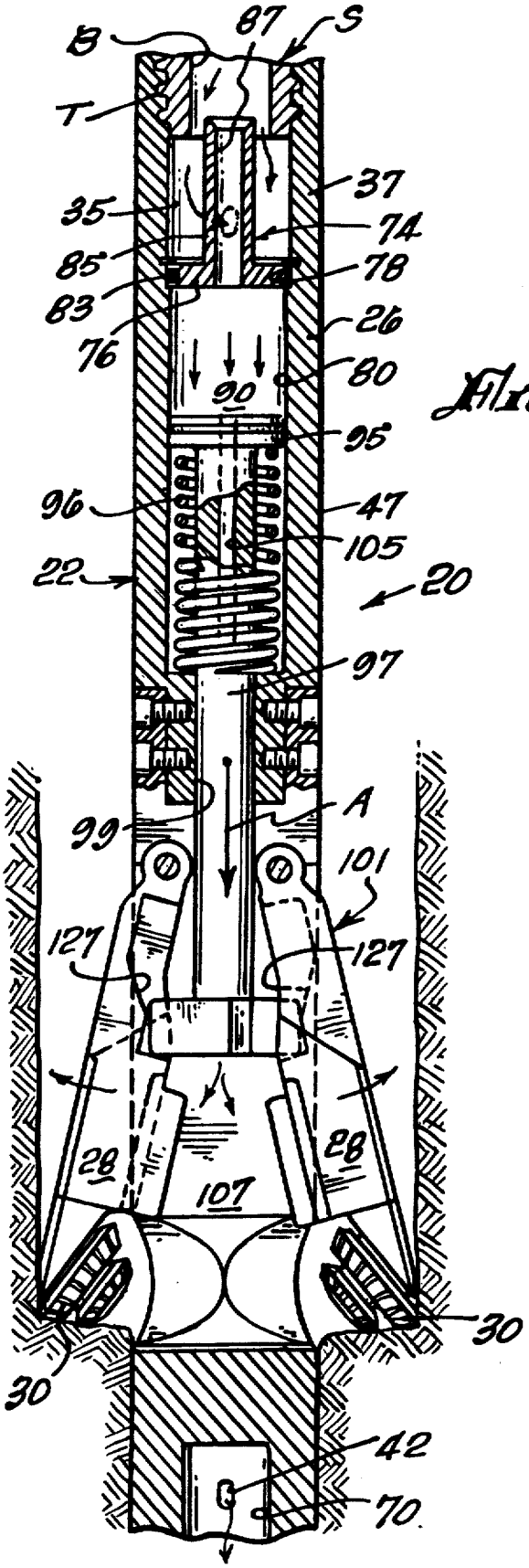
Figure 7:
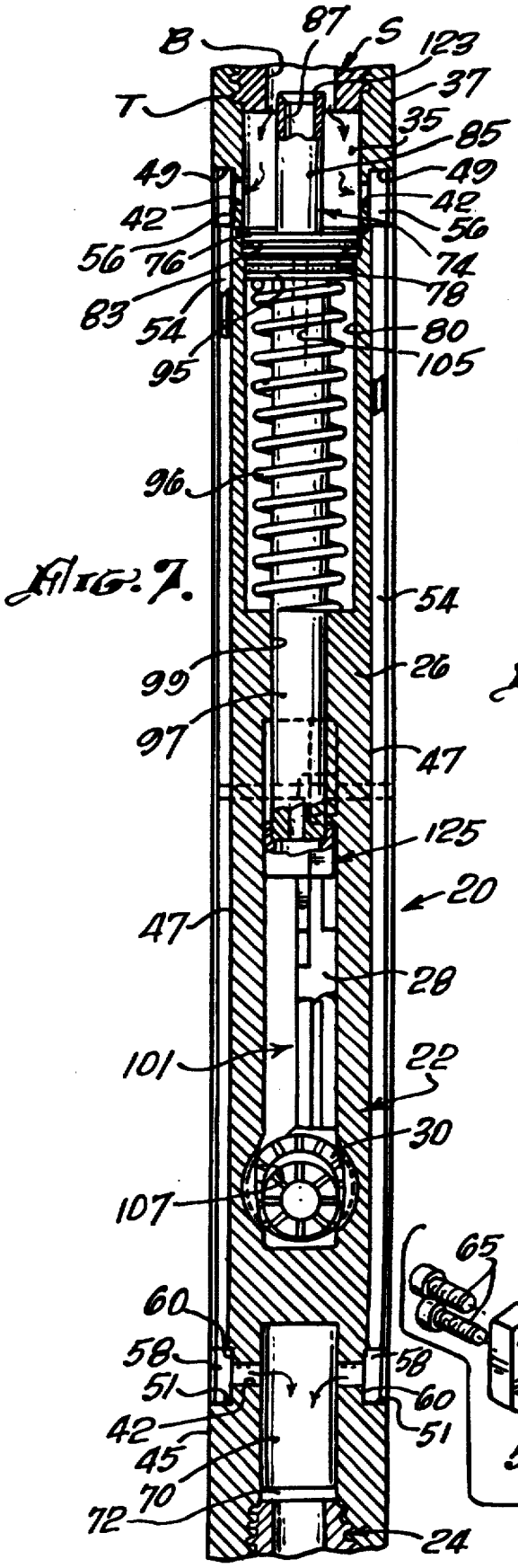
Figure 8:
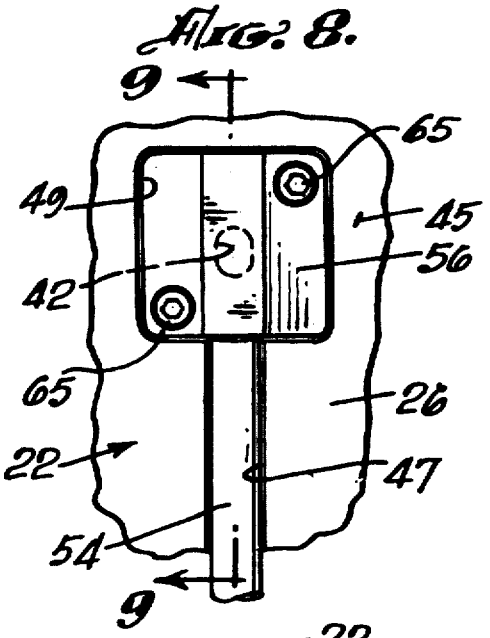
Figure 9:
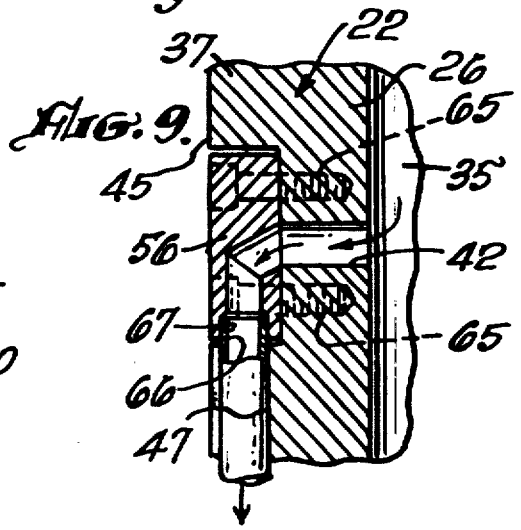
Figure 10:
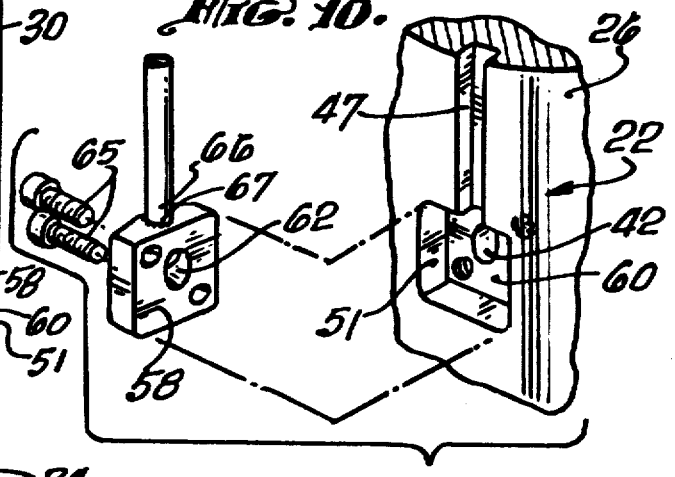

Having thus described the environment in which the present invention is effective, a detailed description of a preferred embodiment of the tool will be hereinafter provided, in conjunction with the drawings, wherein:

FIG. 1 is a pictorial view of the tool with the underreamer section actuated;

FIG. 2 is a side elevation showing an external view of a portion of the drilling mud distribution system;

FIG. 3 is a side elevation of the tool, rotated 90° from FIG. 2 showing the underreamer arm in its nested position;

FIG. 4 is an enlarged cross section, as viewed along line 4—4 of FIG. 2, illustrating particularly, the underreamer section of the tool in its nested condition;

FIG. 5 is a pictorial view of a drilling mud control mechanism;

FIG. 6 is a view similar to FIG. 4, but showing the tool in actuated condition;

FIG. 7 is a section along line 10—10 of FIG. 3, illustrating the fluid system for actuating the underreamer cutter arms;

FIG. 8 is an enlarged elevational view of the external portion of the mud distribution system, illustrating the upper bypass fitting;

FIG. 9 is a section along line 9—9 of FIG. 8; and,

FIG. 10, which is similar to FIG. 8, is an exploded fragmentary view of the lower fitting to bypass fluid.

DESCRIPTION OF A PREFERRED EMBODIMENT

With reference now to the drawings, and initially to FIG. 1, a combination drilling and underreamer tool 20, is illustrated, embodying the novel features of the present invention. As shown, the tool basic components comprise an underreamer section 22, and beneath the underreamer section 22, as the tool 20 is configured in the hole, is a drill bit assembly 24.

As best seen in FIGS. 1 and 7, the tool attaches and is hung on a drill string S by means of a threaded connection T, which is standard in the industry. Each section of the drill string S is cylindrical and has a centrally disposed bore B, which communicates directly with the tool 20, as will be more particularly described hereinafter.

With reference first to the underreamer section 22, as seen in FIGS. 2 and 3, it is embodied in a longitudinal cylindrical body member 26. The underreamer mechanism itself includes a pair of cutter arms 28, which are spring biased into a normally nested position. The cutter arms are in opposed relationship to one another, and in their secured, or nested, position, as seen in FIG. 3, are essentially flush with the outer periphery of the cylindrical body member 26.

As is well known in drilling operations, a fluid is used as a combination lubricant, and means for carrying away particulate matter from the immediate venue of the cutters, whether it be at the drill bit or underreamer. The present invention employs a unique, and highly efficient, drilling mud distribution system, which serves to lubricate both underreamer and drill bit cutters, while carrying particulate from the immediate area thereof, but also functions to deploy and retract the underreamer cutters, on command.

In accordance with this important aspect of the invention, the value of the system may be best appreciated by describing it in terms of its three principal functions, and the structure which permits its novel operation.

A well recognized use of drilling fluid, often referred to as mud, is to lubricate and clean debris from the immediate area of the drill bit 24, and in the present instance, of the combination tool, the underreamer cutters 30 carried by the cutter arms 28. Since the tool of the present invention combines both a drilling and underreaming function, which functions are performed at different locations along the tool, proper timing and distribution of mud becomes a logistical problem. This is particularly true with respect to the underreamer mechanism, which is enclosed within the cylindrical body member 26 of the tool 20, and which is deployed, upon command, by fluid pressure.

Drilling fluid, or mud, is pumped, under appropriate pressure, through the bore B in the string S, and as may be seen in FIGS. 4, 6 and 7 in particular, enters an upper fluid receiving and distribution chamber 35 in the upper end 37 of the tool 20.

It is an important feature of the present invention that when the underreamer section is not in use the drilling mud be permitted to bypass the underreamer section 22 of the tool 20 and impinge directly on the drill bit 24, and specifically, the cutter wheels 40 thereof. This is accomplished, in accordance with the present invention, by first providing a fluid bypass system, which includes a series of coaxial lateral ports 42 in the side walls of the cylindrical body member 26, which defines the chamber 35. Referring to FIGS. 1, 2 and 7, the exterior circumferential wall 45 of the cylindrical body member 26 is provided with a pair of longitudinally extending, preferably coplaner, elongated channels 47. Each channel 47 terminates in a recess 49 at its upper extremity, and a recess 51 at its lower extremity.

The channels 47 are configured to receive a fluid bypass conduit 54, so as to be flush with the periphery of the cylindrical body member 26. Each of the bypass conduits has an upper block seal 56 and a lower block seal 58, which are constructed to fit snugly, in sealing relation, against the floor 60 of each of the recesses 49 and 51, respectively. As best seen in FIGS. 9 and 10, each block seal has a passage 62 formed in it which traverses an approximate right angle, and the mouth of the passage 62, in the case of block seal 56, for example, mates with a lateral port 42 where it is secured by fasteners 65 to the wall of the cylindrical body member 26. An end 66 of bypass conduit 54 is received, in sealing relation, in a countersunk port 67, and as will be seen in FIG. 2 in particular, the entire bypass system is flush with the exterior circumferential wall 45 of the cylindrical body member 26. Thus, the bypass system will not impede rotation, or reciprocal movement of the tool in the hole.

To complete the bypass of the underreamer section, the lower end of the bypass conduit 54 is configured with a similar structure. Thus, a lower block seal 58 is fitted into the recess 51 where the passage 62 thereof communicates with an internal chamber 70 located beyond the lower extremity of the underreamer section 22 of the tool 20 and immediately above the drill bit 24. The chamber opens, as at 72, directly onto the surface of cutter wheels 40 of the drill bit.

It will be appreciated that drilling mud forced dow the bore B of the drill string S will, in part, be discharged into each of the bypass conduits 54 via the coaxial lateral ports 42, which interconnect the chamber 35 to the passages 62 in the upper block seal. The drilling mud so bypassed will traverse the conduit 54 and, via the passage 62 in the lower block seal 58, enter the chamber 70 and be dispersed onto the cutter heads 40 of the drill bit 24.

It will be understood that, if money were no object, the bypass system might be formed, or cut, directly into the cylindrical body member wall. Size and financial considerations make such alternatives prohibitive.

As will appear later in this description, it has been found desirable to have a certain amount of drilling mud diverted to the bypass system at all times to provide for cleaning and lubrication thereof.

The system for dispersing drilling mud to the underreamer cutter heads, as will be appreciated, traverses, in accordance with the present invention, a separate, and entirely different, path.

With specific reference to FIG. 7, the chamber 35 is isolated from the underreamer section 22 by means of a separator member, indicated generally at 74. The separator member, as seen in cross-section in FIG. 7, comprises a transverse cylindrical base 76, which is preferably seated in a groove 78 formed in the inner wall 80 of the cylindrical body member 26. A fluid tight seal is assured by means of an 0 ring, or similar device, 83. The separator member includes a tubular riser 85, which is either formed, or otherwise connected, with the base 76, and a central bore 87 defined in the riser, which penetrates the cylindrical base 76 to provide fluid communication between the chamber 35 and the underreamer cylinder 90.

Still referring to FIG. 7, the underreamer includes a fluid motor, comprising a piston 95, which reciprocates in the cylinder 90 in response to fluid pressure, causing a connecting rod 97, attached to the piston, to respond accordingly. The rod 97 is, of course, reciprocable in a guide bore 99, which is also sealed to prevent excessive discharge of mud past the rod into the cutter head assembly of the underreamer tool, shown generally at 101. Some blowby can be expected, however.

In order to permit drilling mud to reach the underreamer cutter heads, the piston 95 is configured with a small, centrally disposed, opening 103, which aligns with the central bore 87 of the separator member 74, and directly communicates with a central passage 105, which extends the length of the connecting rod 97, opening into the cutter assembly chamber 107, which houses the cutter head assembly 101. Accordingly, means is provided for the selective discharge of a certain amount of drilling mud into the cutter head chamber 107 to lubricate and clean the cutter heads 30 of the underreamer.

As previously discussed, it is common to employ the use of separate drilling and underreamer tools in the field. In order to use separate tools, however, the driller must pull the string each time a tool is to be changed, and while the drill bit must be pulled from time to time in any event because it becomes dull, it is not easy to coordinate the dulling of the drill bit, and the need to underream a production area.

Thus, one of the most perplexing problems faced by drillers is to minimize the length of time lost, and the resultant costs, as a result of having to repeatedly pull the entire string to change tools. While some efforts have been made to combine drilling and underreaming tools, until the advent of applicant's invention, excessive time continues to be wasted in attempting to resolve the problem of deployment and retraction of the underreamer tool, upon command, without resort to either pulling the tools, or providing a complex system of mud flow controls which, in and of themselves, either starve the drill bit, or flood it, or cause similar problems with the underreamer tool while attempting to deploy and retract it.

The present invention resolves this perplexing dilemma by coupling the fluid mud distribution system just described with an exceedingly simple, yet highly effective, means of harnessing the inherent pressure of the drilling mud being pumped to the tool to perform the function of deployment of the underreamer cutter arms 28, against the bias spring 96 virtually on command.

With particular reference now to FIGS. 4, 5 and 7, a device for selectively blocking fluid flow to the underreamer is provided, and in accordance with this aspect of the invention, comprises a spool valve-like device, herein referred to simply as a dart 110. As illustrated, the dart 110, comprises a cylindrical rod portion 112 having a land 114 formed about its periphery. Near the upper end 116 of the dart 110 a second land 118 is formed, in this instance having a seat 120. The dart 110 is of such configuration as to be received in the central bore 87 of the riser portion 85 of the separator member 74, such that the seat 120 mates with, and seats upon, the tapered seat 123 at the top of the riser 85. Thus, when the dart 110, which is reciprocably in the drill string, is dropped through the central bore B of the string S it is guided into the riser 85 by the nose 121, where it eventually comes to rest in the bore 87 of the riser 85. As a result of the seal formed between surfaces 120 and 123, the upper cylinder portion 90 is sealed against both pressure and flow of drilling mud, which is now diverted entirely into the bypass conduits 54, and the result is that the underreamer cutter arms 28 are retracted by spring pressure of the piston 95 by spring 96, and nested in the cylindrical body member 26, and the underreamer is disabled.

On the other hand, when the dart 110 is fished from the central bore 87, a portion of the drilling mud, preferably about 30% by volume, is allowed to enter the chamber 90 under pressure, forcing the piston 95 downwardly, in the direction of the arrow A. A cam mechanism 125 disposed at the opposite end of the connecting rod 97 operates on cam followers 127 to extend the arms 28, while at the same time, mud flowing through the central passage 105, lubricates and cleans the cutters 30.

In order to retrieve the dart 110, and consequently activate the underreamer tool, means is provided, as seen in FIG. 5, such as a Kuster-type PDD overshot 130, which is a well known tool in the art, and which is configured to engage the head 116 of the dart 110, which has a PDD construction. With the dart 110 in position as shown in FIG. 4, the PDD overshot is lowered on a string 135 having a sinker bar 137 until it engages the head 116. Once engaged, the dart 110 is readily removed to actuate the underreamer.

The ability to drop the dart into position to disable the underreamer tool, and the concurrent ability to fish out the dart to activate the underreamer tool, all from the surface, results in a tremendous savings in time and money, all of which is accomplished in the novel manner of the present invention.

Having thus described the preferred embodiment of the present invention, what is claimed is:

1. In a combined drill and underreamer tool adapted to depend from a drill string to selectively drill and underream a well hole upon command, the combination of:

an elongated cylindrical body member, said cylindrical body member having upper and lower ends and an exterior circumferential wall therebetween, and being connected to the drill string at its upper end, the drill string being tubular, and having fluid under a predetermined pressure flowing therein;

a drill bit assembly connected to, and depending from, the lower end of said cylindrical body member;

means defining an underreamer device in said cylindrical body member, said underreamer device including opposed cutter arms nested in said cylindrical body member, and being extendable in response to application of fluid pressure;

means defining a chamber in said cylindrical body member, said chamber being located above said underreamer device, and being in fluid communication therewith said drill bit assembly; and means for selectively blocking and unblocking fluid flow to said underreamer device, to activate and deactivate said cutter arms.

2. The apparatus as set forth in claim 1, wherein fluid bypass means is provided, said fluid bypass means interconnecting said chamber and said drill bit assembly to provide fluid to said drill bit.

3. The apparatus as set forth in claim 1, wherein said underreamer device includes fluid motor means, said fluid motor means being responsive to the application of fluid under pressure from said chamber to extend said cutter arms.

4. The apparatus as set forth in claim 3, wherein said underreamer device further includes means to bias said cutter arms to their nested position when fluid pressure on said fluid motor means is relieved.

5. The apparatus as set forth in claim 3, wherein a restricted fluid passage is provided between said chamber and said cutter arms, so as to provide fluid from said chamber to cutter arms when said cutter arms are extended to thereby lubricate and clean the same.

6. The apparatus as set forth in claim 1, wherein fluid bypass means is provided between said chamber and said drill bit assembly; said fluid bypass means extending longitudinally along the exterior circumferential wall of said cylindrical member and is flush therewith.

7. The apparatus as set forth in claim 6, wherein said exterior circumferential wall of said cylindrical member is formed with longitudinally extending channels therein, means defining fluid ports in said circumferential wall between said channels and said chamber; and fluid bypass conduit disposed in said channels and connected to said ports to direct fluid under pressure from said chamber to said drill bit.

8. The apparatus as set forth in claim 1 wherein a separator means is provided between said chamber and said underreamer device, said separator having a central bore to provide fluid communication between said chamber and said underreamer means.

9. The apparatus as set forth in claim 8, wherein said separator means includes means defining a riser centrally disposed thereon, said riser defining said central bore; the upper end of said riser terminating in a tapered seat; blocking means reciprocably disposed in said drill string and chamber in axial alignment with said seat; said blocking means being movable, upon command, into and out of sealing contact with said seat to thereby selectively permit fluid under pressure to pass through said bore to said underreamer means.

10. The apparatus as set forth in claim 8, wherein the size of said bore relative to the size of said ports is such as to permit up to 30% of the fluid in said chamber to pass to said underreamer means when said blocking means is unseated, while the remainder thereof is distributed through said fluid bypass means to said drill bit assembly.

11. The apparatus as set forth in claim 9, wherein said blocking means comprises an elongated cylindrical dart, said dart having a lower end, said lower end being formed with a seat so formed as to mate, in sealing relation, with said tapered seat on said riser.

12. The apparatus as set forth in claim 11, wherein said dart is seated with said riser by dropping the same such that the dart falls into sealing engagement with said riser.

13. The apparatus as set forth in claim 12, wherein means is provided in said drill string for returning said dart to unseat the same from said riser.

14. The apparatus as set forth in claim 5, wherein said restricted fluid passage is formed in said fluid motor.

15. The apparatus as set forth in claim 2, wherein said underreamer device includes fluid motor means, said fluid motor means being responsive to the application of fluid under pressure from said chamber to extend said cutter arms.

16. The apparatus as set forth in claim 2, wherein a restricted fluid passage is provided between said chamber and said cutter arms, so as to provide fluid from said chamber to cutter arms when said cutter arms are extended, to thereby lubricate and clean the same.

17. The apparatus as set forth in claim 2, wherein fluid bypass means is provided between said chamber and said drill bit assembly; said fluid bypass means extending longitudinally along the exterior circumferential wall of said cylindrical member and is flush therewith.

18. The apparatus as set forth in claim 2, wherein said exterior circumferential wall of said cylindrical member is formed with longitudinally extending channels therein; means defining fluid ports in said circumferential wall between said channels and said chamber; and fluid bypass conduit disposed in said channels and connected to said ports to direct fluid under pressure from said chamber to said drill bit.

19. The apparatus as set forth in claim 9, wherein said separator means includes means defining a riser centrally disposed thereon, said riser defining said central bore; the upper end of said riser terminating in a tapered seat; blocking means reciprocably disposed in said drill string and chamber in axial alignment with said seat; said blocking means being movable, upon command, into and out of sealing contact with said seat to thereby selectively permit fluid under pressure to pass through said bore to said underreamer means.

20. The apparatus as set forth in claim 2, wherein the size of said bore relative to the size of said ports is such as to permit up to 30% of the fluid in said chamber to pass to said underreamer means when said blocking means is unseated, while the remainder thereof is distributed through said fluid bypass means to said drill bit assembly.

21. The apparatus as set forth in claim 2, wherein said dart is seated with said riser by dropping the same such that the dart falls into sealing engagement with said riser.

22. The apparatus as set forth in claim 2, wherein means is provided in said drill string for returning said dart to unseat the same from said riser.

23. The apparatus as set forth in claim 2, wherein separator means is provided between said chamber and said underreamer device, said separator having a central bore to provide fluid communication between said chamber and said underreamer means.

24. The apparatus as set forth in claim 23, wherein said separator means includes means defining a riser centrally disposed thereon, said riser defining said central bore; the upper end of said riser terminating in a tapered seat; blocking means reciprocably disposed in said drill string and chamber in axial alignment with said seat; said blocking means being movable, upon command, into and out of sealing contact with said seat to thereby selectively permit fluid under pressure to pass through said bore to said underreamer means.

25. The apparatus as set forth in claim 10, wherein the size of said bore relative to the size of said ports is such as to permit up to 30% of the fluid in said chamber to pass to said underreamer means when said blocking means is unseated, while the remainder thereof is distributed through said fluid bypass means to said drill bit assembly.

* * * * *